US007779637B2

(12) United States Patent
Heilos

(10) Patent No.: US 7,779,637 B2
(45) Date of Patent: Aug. 24, 2010

(54) HEAT SHIELD

(75) Inventor: Andreas Heilos, Mülheim (DE)

(73) Assignee: Siemens Aktiengesellschaft, Munich (DE)

( * ) Notice: Subject to any disclaimer, the term of this patent is extended or adjusted under 35 U.S.C. 154(b) by 979 days.

(21) Appl. No.: 11/347,545

(22) Filed: Feb. 3, 2006

(65) Prior Publication Data

US 2006/0176671 A1 Aug. 10, 2006

(30) Foreign Application Priority Data

Feb. 7, 2005 (EP) ..... 05002511

(51) Int. Cl.
*F02C 1/00* (2006.01)

(52) U.S. Cl. ..... 60/752; 60/796

(58) Field of Classification Search ..... 60/796, 60/752–760, 798–800
See application file for complete search history.

(56) References Cited

U.S. PATENT DOCUMENTS

| | | | | |
|---|---|---|---|---|
| 4,441,324 | A | 4/1984 | Abe et al. | |
| 5,083,424 | A * | 1/1992 | Becker | 60/796 |
| 5,107,641 | A * | 4/1992 | Davis | 52/127.7 |
| 5,265,411 | A | 11/1993 | Belsom | |
| 5,302,465 | A * | 4/1994 | Miller et al. | 428/552 |
| 5,431,020 | A | 7/1995 | Maghon | |
| 6,210,067 | B1 * | 4/2001 | Postma et al. | 403/30 |
| 6,286,317 | B1 | 9/2001 | Burrus et al. | |
| 6,397,765 | B1 * | 6/2002 | Becker | 110/336 |
| 6,705,832 | B2 * | 3/2004 | Tiemann | 415/116 |
| 6,711,899 | B2 * | 3/2004 | Bast et al. | 60/752 |
| 7,082,771 | B2 * | 8/2006 | Jeppel et al. | 60/798 |
| 2002/0050237 | A1 | 5/2002 | Becker | |
| 2003/0165381 | A1 * | 9/2003 | Fokine et al. | 415/110 |
| 2004/0146399 | A1 * | 7/2004 | Bolms et al. | 415/175 |
| 2005/0000228 | A1 * | 1/2005 | De Sousa et al. | 60/796 |
| 2006/0016173 | A1 * | 1/2006 | Dhaliwal | 60/226.1 |
| 2007/0151249 | A1 * | 7/2007 | Barbeln et al. | 60/752 |

FOREIGN PATENT DOCUMENTS

| | | | |
|---|---|---|---|
| DE | 196 31 616 | A1 | 2/1998 |
| EP | 0 112 622 | A2 | 7/1984 |
| EP | 0 558 540 | B1 | 9/1993 |
| EP | 1 010 944 | A2 | 6/2000 |
| EP | 1 128 131 | A1 | 8/2001 |
| EP | 1 521 018 | A1 | 4/2005 |
| WO | WO 92/09850 | A1 | 6/1992 |

* cited by examiner

*Primary Examiner*—William H Rodríguez
*Assistant Examiner*—Phutthiwat Wongwian

(57) ABSTRACT

A heat shield is provided on a supporting structure with a number of heat shield elements, which are fixed to a large area of the supporting structure leaving gaps between adjacent heat shield elements, a number of securing elements with which the heat shield elements are fixed to the supporting structure and which have a grip section engaging in the heat shield elements and a cooling system for cooling the securing elements, the cooling system being designed such that cooling fluid can be supplied directly to the grip sections of the securing elements.

12 Claims, 4 Drawing Sheets

HEAT SHIELD

CROSS REFERENCE TO RELATED APPLICATIONS

This application claims priority to European Patent application No. EP05002511.3 filed Feb. 7, 2005. The application is incorporated by reference herein in the entirety

FIELD OF THE INVENTION

The present invention relates to a heat shield on a supporting structure with a number of heat shield elements, which are fixed to a large area of the supporting structure leaving gaps between adjacent heat shield elements, with a number of securing elements with which the heat shield elements are fixed to the supporting structure and which have a grip section engaging in the heat shield elements and with a cooling system for cooling the securing elements. The present invention also relates to a heat shield element and a securing element for securing a heat shield element to a supporting structure.

BACKGROUND OF THE INVENTION

Heat shields are used for example in combustion chambers or flame tubes, which may be part of a kiln, a hot gas channel or a gas turbine and in which a hot medium is produced or guided. Gas turbine combustion chambers that are subject to high levels of thermal loading are thus for example lined with a heat shield to protect against excessive thermal stress. The heat shield typically comprises a number of heat shield elements disposed over a large area of a supporting structure to shield the walls of the combustion chamber from the hot waste gases from the combustion process. In order not to impede the thermal expansion of the heat shield elements on contact with the hot waste gases from the combustion process, said elements are fixed to the supporting structure leaving gaps between adjacent heat shield elements.

Such a heat shield on a supporting structure is for example disclosed in EP 0 558 540 B1. In this heat shield ceramic heat shield elements have a hot side to face the hot waste gases, a cold side opposite the hot side and four peripheral sides connecting the hot side to the cold side. Two peripheral sides facing away from each other have grooves, in which grip sections of securing elements can engage. The securing elements have a fixing section for fixing to the supporting structure and a securing head with the grip section. To fix the heat shield elements to the supporting structure, the fixing sections are fixed to the supporting structure and the grip sections of the securing heads are made to engage with the grooves in the heat shield elements.

The securing elements are made of metal and have spring characteristics. The spring characteristics allow the securing head to yield when the heat shield elements expand due to thermal effects, thereby preventing the formation of cracks in the heat shield elements or fracturing of the securing elements. Also the spring effect allows movement of the heat shield elements in relation to the supporting structure within certain limits.

So that the thermal expansion and/or the movement of the heat shield elements is not impeded by adjacent heat shield elements, in EP 0 558 540 B1 these are disposed leaving gaps between adjacent heat shield elements. However hot gas can penetrate through the gaps into the heat shield in the direction of the metal securing elements. As the metal securing elements are generally less able to tolerate thermal loading than the ceramic heat shield elements, the gaps are flushed with cooling air, to prevent penetration of the hot gas into the gaps. Flushing results in a mass air flow, which enters the combustion chamber through the gaps and seals the gaps against penetration of the hot gases. A channel for supplying a cooling fluid is assigned to every securing element for cooling purposes. The sealing of the gaps between the heat shield elements is not however regular, meaning that more cooling air is necessary for reliable sealing than would theoretically be required for sealing the gaps.

The mass air flow required to seal the gaps is not available for combustion purposes and has an adverse effect on the potential for NOx minimization. Also the geometry and arrangement of the securing elements make effective cooling of the securing heads exposed to the hot gas problematic.

SUMMARY OF THE INVENTION

In contrast to this prior art the object of the present invention is to provide a heat shield on a supporting structure, in which advantageous cooling of securing elements securing the heat shield elements of the heat shield is possible.

A further object of the invention is to provide an advantageous securing element to secure a heat shield element having at least one groove on a supporting structure.

It is also an object of the present invention to provide a heat shield element, which advantageously allows cooling of a securing element securing the heat shield element.

The first object is achieved by a heat shield according to the claims, the second object by a securing element according to the claims and the third object by a heat shield element according to the claims. The dependent claims contain advantageous embodiments of the invention.

A claimed securing element for securing a heat shield element having at least one groove on a supporting structure comprises a securing head, which has a grip section configured appropriately to engage in the groove of the heat shield element and a fixing section configured appropriately to fix the securing element to the supporting structure. In the claimed securing element at least one through opening in the fixing section is disposed and configured such that when the fixing section is fixed to the supporting structure it is possible for the cooling fluid to be supplied directly to the grip section through the through opening from the supporting structure.

The direct supply of the cooling fluid to the grip section of the securing element means that it is possible to cool this effectively without necessarily having to seal the entire gap between adjacent heat shield elements with sealing air.

In one embodiment of the invention, which allows a particularly low level of sealing air consumption and in which the grip section has a hot surface to face a hot medium and a cold surface facing away from the hot surface, the through opening is disposed such that the cooling fluid can be supplied to the cold surface. This means that the cooling fluid supplied to the cold surface must first flow round the cold surface before it can penetrate into the gap between adjacent heat shield elements. As it flows round the cold surface, said surface is cooled, so that the same cooling power can be achieved as in the prior art but with a smaller quantity of cooling fluid.

Cooling power can be further increased if the through opening is disposed in the fixing section such that cooling fluid can be blown directly onto at least one section of the cold surface from one direction, which forms an acute angle with the surface normal of the blown section. This embodiment in particular allows effective impact cooling of the cold surface, i.e. cooling whereby a jet of cooling fluid strikes the surface to be cooled. After striking the blown section of the cold surface, the cooling fluid flows along the remaining sections of the cold surface into the gap between the heat shield elements. The flowing cooling fluid thereby results in convective cooling of the remaining areas of the grip section.

In the claimed securing element the through opening can be configured as an elongated hole. Configuration as an elongated hole increases the margin when fixing the securing element to the supporting structure without the possibility of impeding the direct supply of cooling fluid to the grip section. The elongated hole can also be configured such that it can be used at the same time as a disassembly hole.

In a further advantageous embodiment of the claimed securing element the grip section has a longitudinal cross-section, which has a curved section, the bulge of which points away from the securing section. This allows a cooling fluid channel to be configured between the grip section of the securing element and a secured heat shield element, said channel being formed on the one hand by the heat shield element and on the other hand by the curved grip section. Depending on the nature of the curved section, a larger or smaller flow cross-section is created for the cooling fluid such that this can be tailored in an optimum manner to the required cooling power.

The demand for cooling fluid can be further reduced if the hot surface of the grip section has a heat-insulating coating. In addition or alternatively the hot surface can also be provided with a corrosion-inhibiting and/or oxidation-inhibiting coating. All the effects can thereby be achieved in a single coating.

A claimed heat shield element comprises a hot side to face a hot medium, a cold side opposite the hot side and the peripheral sides connecting the hot side to the cold side. A groove is configured in at least one of the peripheral sides, having at least one engagement section. The material section between the groove and the cold side forms a securing bar, which has at least one recess opening the groove up to the cold side in the area of the engagement section.

The recess in the securing bar makes it possible to supply cooling fluid directly to a securing section engaging in the groove of the heat shield element, thereby improving the cooling effect in the area of the grip section.

In particular grooves with recesses opening the respective groove up to the cold side can be present in at least two peripheral sides of the heat shield element facing away from each other. This makes it possible to secure the heat shield element on two sides facing away from each other with directly cooled securing elements, thereby achieving a bracket effect to secure the heat shield element with the directly cooled securing elements.

The claimed heat shield element offers a particularly high level of resistance and heat insulation, when it is configured as a ceramic heat shield element.

A claimed heat shield on a supporting structure comprises a number of heat shield elements, which are fixed to a large area of the supporting structure leaving gaps between adjacent heat shield elements, a number of securing elements, with which the heat shield elements are fixed to the supporting structure and which have a grip section engaging in the heat shield elements, as well as a cooling system for cooling the securing elements. In the claimed heat shield the cooling system is configured such that it is possible to supply cooling fluid directly to the grip sections of the securing elements.

With the effective cooling of the critical areas of the metallic securing elements, specifically the grip sections, which is possible with the claimed embodiment of the heat shield, it is possible to reduce the requirements for sealing the gaps between adjacent heat shield elements. This reduces cooling air consumption. As a result of the decrease in cooling air consumption, it is possible to decrease the combustion temperature, thereby reducing the thermal stress loading in the heat shield elements. NOx emissions are also positively influenced. It is therefore possible either to reduce the NOx emissions of a gas turbine unit fitted with the claimed heat shield for the same output as a gas turbine according to the prior art or it is possible to increase output and efficiency while the NOx emissions remain at the same level. The drop in the level of stress in the heat shield also reduces the exchange rates of the heat shield elements and the risk of losing a heat shield element.

Particularly effective cooling of the grip sections of the securing elements in the heat shield is possible, if the cooling system is designed such that impact cooling of the grip sections is possible.

In one embodiment of the claimed heat shield the cooling system comprises a number of cooling fluid openings disposed in the supporting structure to blow a cooling fluid out. Also at least some of the heat shield elements are configured as claimed heat shield elements and at least some of the securing elements as claimed securing elements. The securing elements are fixed to the supporting structure and the heat shield elements are secured by the securing elements such that the through openings of the securing elements are aligned respectively with a cooling fluid opening in the supporting structure and a recess in a heat shield element. This embodiment in particular allows impact cooling of the grip sections of the securing elements, whereby a jet of cooling fluid is discharged from a cooling fluid opening and strikes the cold side of the grip section of a heat shield element unimpeded.

The cooling system can also comprise further cooling fluid openings, which are disposed in the supporting structure such that cooling fluid discharged from them is discharged in the direction of fixing sections of securing elements. In particular these further cooling fluid openings can be disposed in the supporting structure such that the cooling fluid discharged from them results in impact cooling of the fixing sections.

BRIEF DESCRIPTION OF THE DRAWINGS

Further features, characteristics and advantages of the present invention will emerge from the description which follows of exemplary embodiments with reference to the accompanying figures, in which.

DETAILED DESCRIPTION OF THE INVENTION

Figure 1:
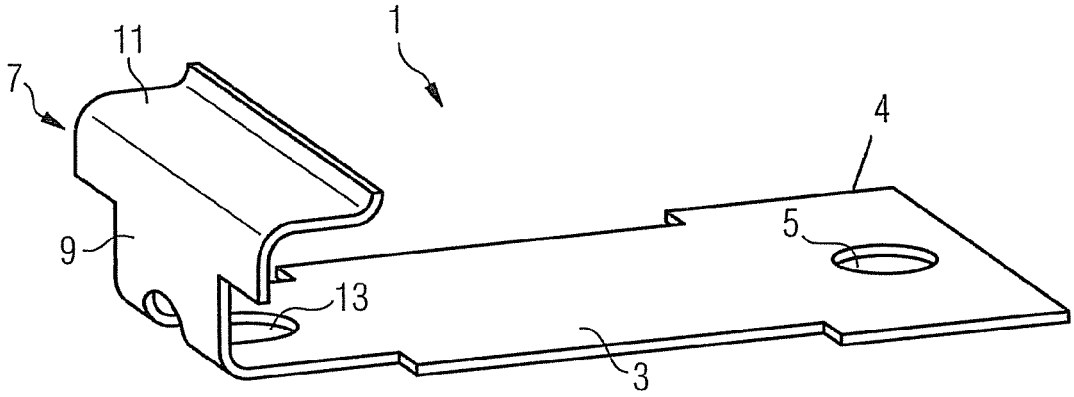
FIG. 1 shows a perspective view of a first exemplary embodiment of a claimed element holder.

A perspective view of a claimed securing element is shown in FIG. 1. The securing element 1 is made of metal and has a fixing section 3, also referred to as the securing spring, which can be used to fix the securing element 1 to a supporting structure of a combustion chamber wall, for example the combustion chamber wall of a gas turbine unit.

Figure 5:
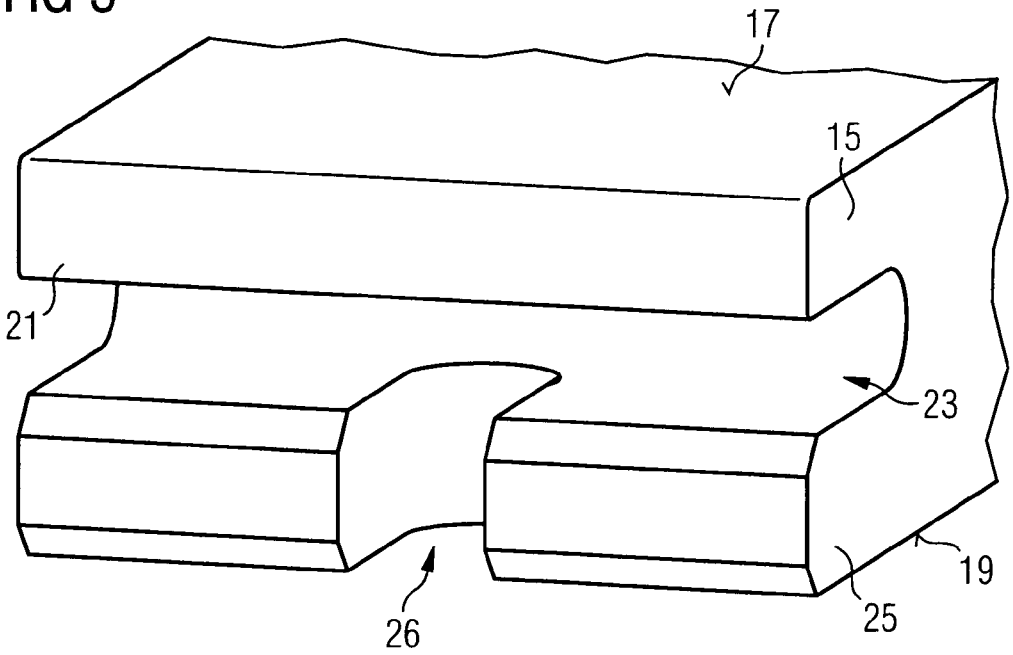
FIG. 5 shows the heat shield element from FIG. 4 without the securing element.

The securing elements are guided on the supporting structure 30 in a groove 31 (see also FIG. 5). An extended section 4 of the fixing section 3, the so-called shoe of the securing element 1, hereby engages with narrow tolerance in an approximately 10 mm deep groove 31 let in parallel to the surface of the supporting structure 30. The groove 31 is configured such that it only has the width required for insertion of the extended section 4 in the groove base 33. If the securing element 1 is raised in the groove 31, it comes up against the narrow area 35 of the groove 31, whereby a securing force is exerted to secure the securing element 1. The part of the fixing section 3 that is not extended can be raised unimpeded in the groove 31. The fixing opening 5 in the extended section 4 is used to fix a number of securing elements 1 in the direction of the groove. A heat shield element is generally secured on two opposing sides of two securing elements 1 respectively, i.e. by four securing elements 1 in total. The securing elements 1 on one of the two sides are held in place by lock studs extending through the fixing openings 5 of the fixing sections 3. The fixing sections 3 of the securing elements 1 disposed on the other side are not held in place, allowing them to slide, so that they do not impede the thermal expansion of the heat shield element.

A securing head 7 is configured at the end of the securing spring 3 opposite the end with the fixing opening 5, said securing head 7 having a section 9 essentially at right angles to the securing spring 3 and a grip section 11, which in turn is essentially at right angles to the section 9. The grip section 11, also referred to as the grip plate, serves to engage in the groove of a heat shield element. A heat shield element can be clamped to the supporting structure by the engagement of grip plates 11 of securing elements 1, which are fixed to a supporting structure, in the grooves of sides of the heat shield element facing away from each other (see FIG. 3).

Figure 2:
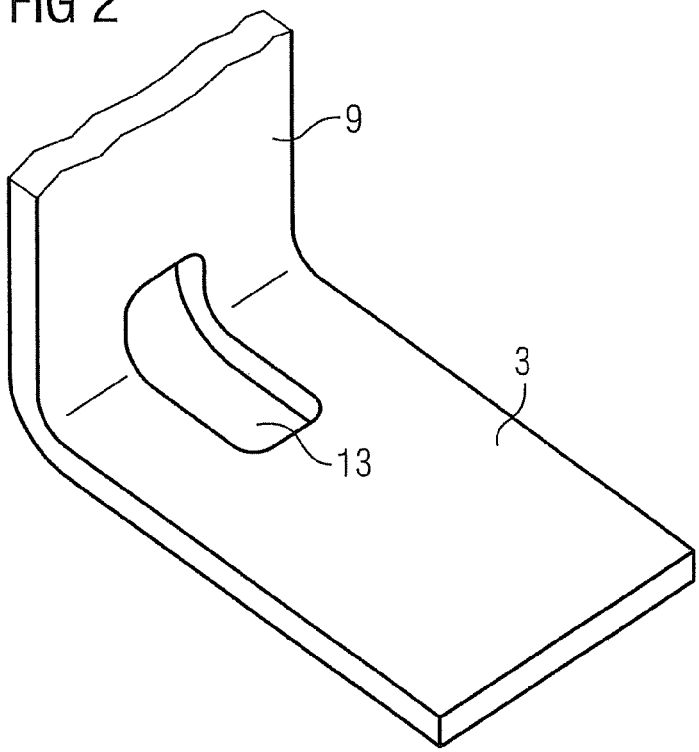
FIG. 2 shows an enlarged view of a section from a claimed element holder.

The securing element 1 has an opening that extends at least partially through the securing spring 3 in the area of transition between the securing spring 3 and the section 9. In the present exemplary embodiment this opening is configured as an elongated hole 13, which allows cooling air to be blown onto the side of the grip plate 11 facing the securing spring 3. An enlargement of a cross-section of the securing element 1 with the securing spring 3, the section 9 and the elongated hole 13 is shown in FIG. 2.

Figure 3:
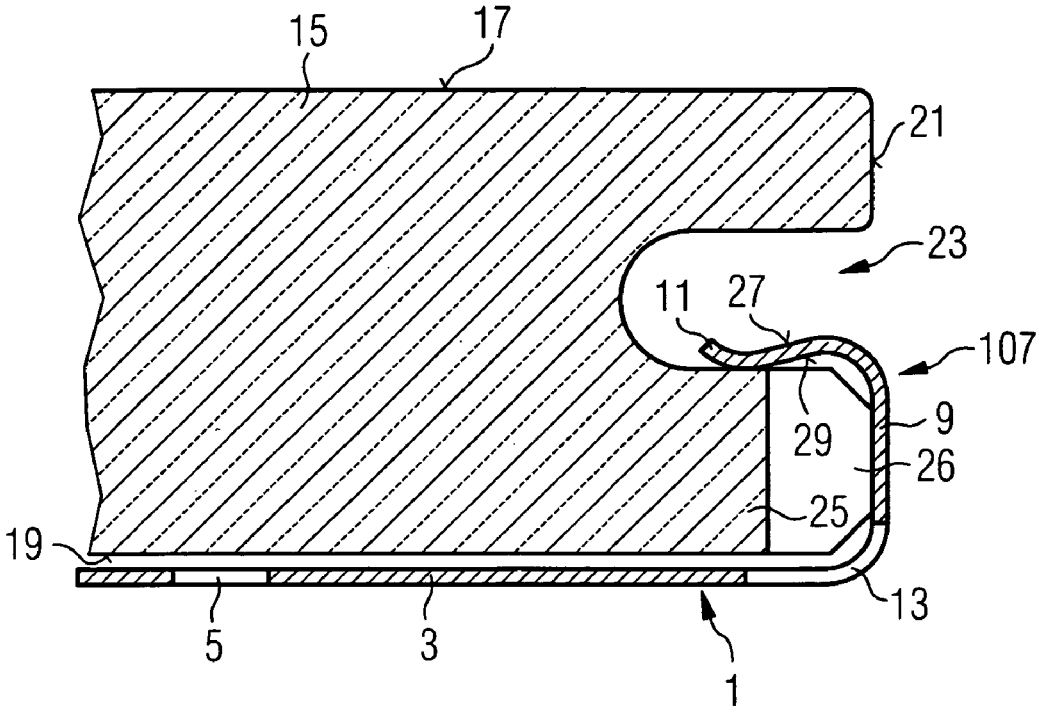
FIG. 3 shows a sectional side view of a claimed element holder and a claimed heat shield element.

FIG. 3 shows a sectional side view of an exemplary embodiment of a claimed heat shield element in the form of a ceramic heat shield element 15 with a hot side 17, a cold side 19 and peripheral sides 21 connecting the hot side 17 to the cold side 19. Two peripheral sides 21 facing away from each other, only one of which can be seen in FIG. 3, have grooves, in which the grip plates 11 of securing elements 1 can engage. The material section between the groove 23 and the cold side 19 of the heat shield element 15 forms a securing bar 25, which allows the heat shield element 15 to be clamped to the supporting structure by means of a securing element 1 engaging in the groove 23. The securing element 1 engages in the groove 23 of the heat shield element 15 by means of the grip plate 11, which comes into contact with the grooved wall on the cold side. The securing element 1 has elastic characteristics, which allow easy insertion of the grip plate 11 into the groove 23 and reliable securing of the ceramic heat shield element 15 to the supporting structure.

As adjacent heat shield elements 15 are positioned next to each other with gaps in between (FIG. 6), the surface of the grip plate 11 facing away from the securing bar 25, hereafter referred to as the hot surface 27, is exposed to the action of hot gas penetrating into the gap 14. To reduce the thermal loading on the metallic securing element 1 in the area of the grip plate 11, cooling air, which in the present exemplary embodiment also serves as cooling fluid, is blown onto the surface 29 of the grip plate 11 facing away from the hot surface 27, hereafter referred to as the cold surface 29.

Figure 4:
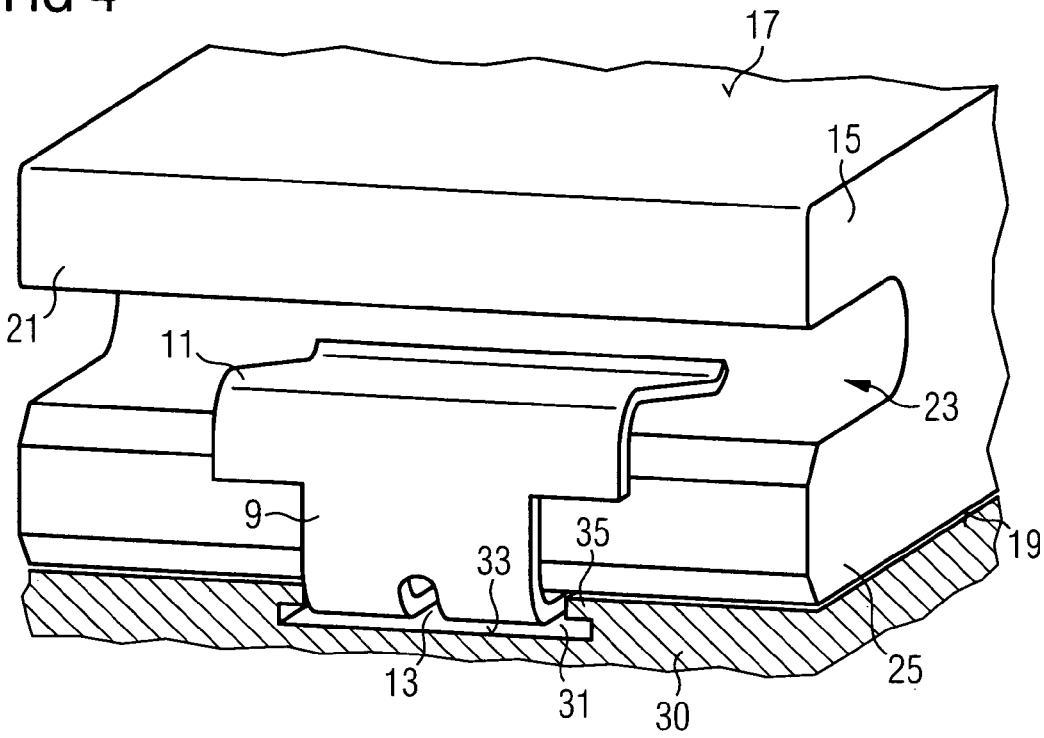
FIG. 4 shows a sectional perspective view of the element holder and heat shield element from FIG. 3.

Cooling air is supplied via cooling air channels 32 present in the supporting structure 30 and blown in the direction of the cold side 29 of the grip plate 11. The cooling air blown out passes through the elongated hole 13 in the direction of the cold surface 29 through the securing element 1. To allow the cooling air to pass through the securing bar 25 of the ceramic heat shield element 15 as well, said ceramic heat shield element 15 has a recess 26 in the area of the grip plate 11. To make this clearer, FIGS. 4 and 5 show a sectional perspective view of the ceramic heat shield element 15, in one instance with the grip plate 11 of a securing elemental engaged with the groove 23 (FIG. 4) and in the other instance without the securing element 1 (FIG. 5).

The cooling air blown out of the cooling air channels 32 can pass through the elongated hole 13 and the recess 26 to reach the cold surface 29 of the grip plate 11 unimpeded, striking the cold surface 29 essentially at right angles. Essentially at right angles here means that the direction of flow forms an acute angle, preferably an angle of maximum 20°, with the surface normal of the cold surface 29 in the area in which the cooling air strikes the cold surface 29. This makes so-called impact cooling possible, ensuring particularly effective cooling of the grip plate 11.

The cooling air striking the cold side 29 is deflected and flows along the cold surface 29 through the flow channel formed between the securing bar 25 and the cold surface 29. At both ends 22 and 24 of the grip plate 11 the cooling air finally discharges from this flow channel into the gap 14 between the heat shield elements 15. The grip plate 11 is thereby cooled in the area in which the cooling air strikes the cold surface in the form of impact cooling and in the areas in which the cooling air flows along the cold surface 29 in a convective manner. The section 9 is also cooled in a convective manner.

Two cooling air channels 34, through the openings of which cooling air is blown out in the direction of the side of the securing spring 3 facing the supporting structure, are also disposed optionally in the supporting structure 30. The cooling air blown out of the cooling air channels 34 then flows along the securing springs 3, thereby cooling the securing springs in a convective manner. The cooling air serving to cool the securing springs 3 in a convective manner finally enters the combustion chamber through the gaps 14 between adjacent heat shield elements 15, whereby it also serves to cool the sections 9 of the securing heads 7 in a convective manner. The dimensions of the cooling air channels 34 can however be reduced compared with heat shields according to the prior art.

As in contrast to the prior art the inside of the securing head 7, and in particular the grip plate 11, is also cooled, an improved cooling effect is achieved in the claimed heat shield. This can be utilized to reduce the expulsion of cooling air and therefore the flow of cooling air into the combustion chamber.

Cooling air consumption can be reduced further if the hot surface 27 of the grip plate 11 is provided with a heat insulating coating, a so-called Thermal Barrier Coating (TBC). In addition or alternatively a corrosion-inhibiting and/or oxidation-inhibiting coating can also be present.

Figure 7:
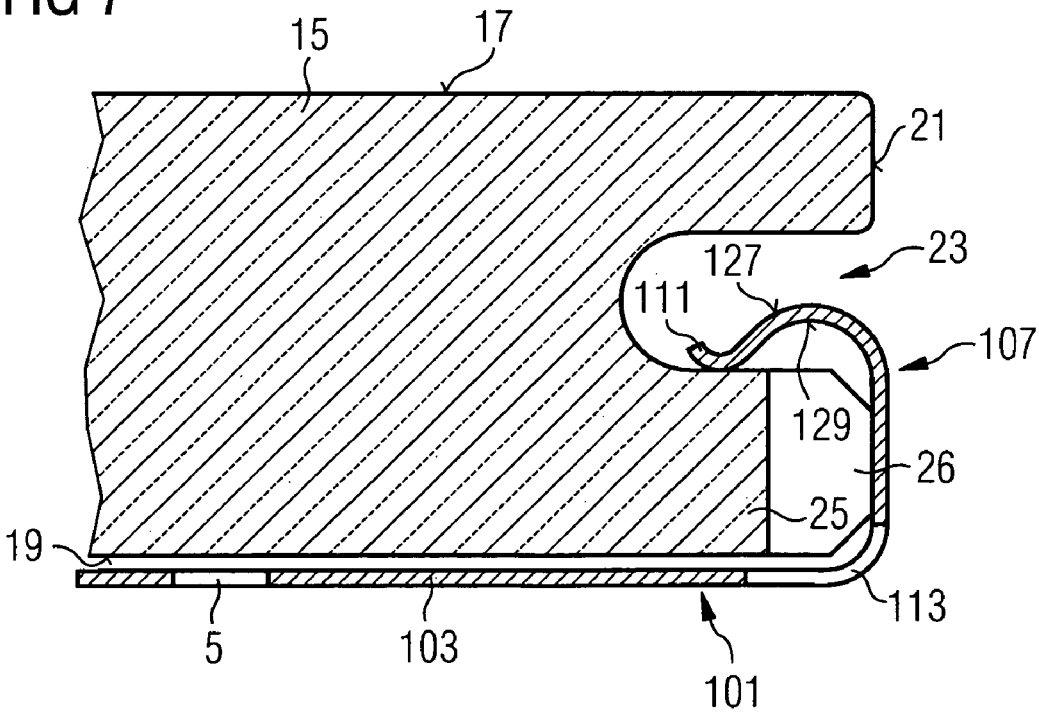
FIG. 7 shows a sectional side view of a heat shield element and an element holder according to a second embodiment of the invention.

A sectional side view of a second embodiment of the claimed securing element is shown in FIG. 7 together with a ceramic heat shield element 15. The securing element 101 according to the second embodiment differs from the securing element 1 according to the first embodiment in that the grip plate 111 of the securing head 107 has a curved section 112, the bulge of which points away from the securing spring 103. This improves the flow away of the cooling air striking the cold surface 129 of the grip plate 11. The flow cross-section of the flow channel formed between the cold surface 129 and the securing bar 25, which is larger than in the first exemplary embodiment, allows more efficient removal of the cooling air in the direction of the outer areas of the grip plate 11, with the result that this and in particular the hot surface 127 can be cooled more effectively. The securing spring 103 and the through hole 113 correspond to the securing spring 3 and through hole 13 of the first exemplary embodiment.

Figure 6:
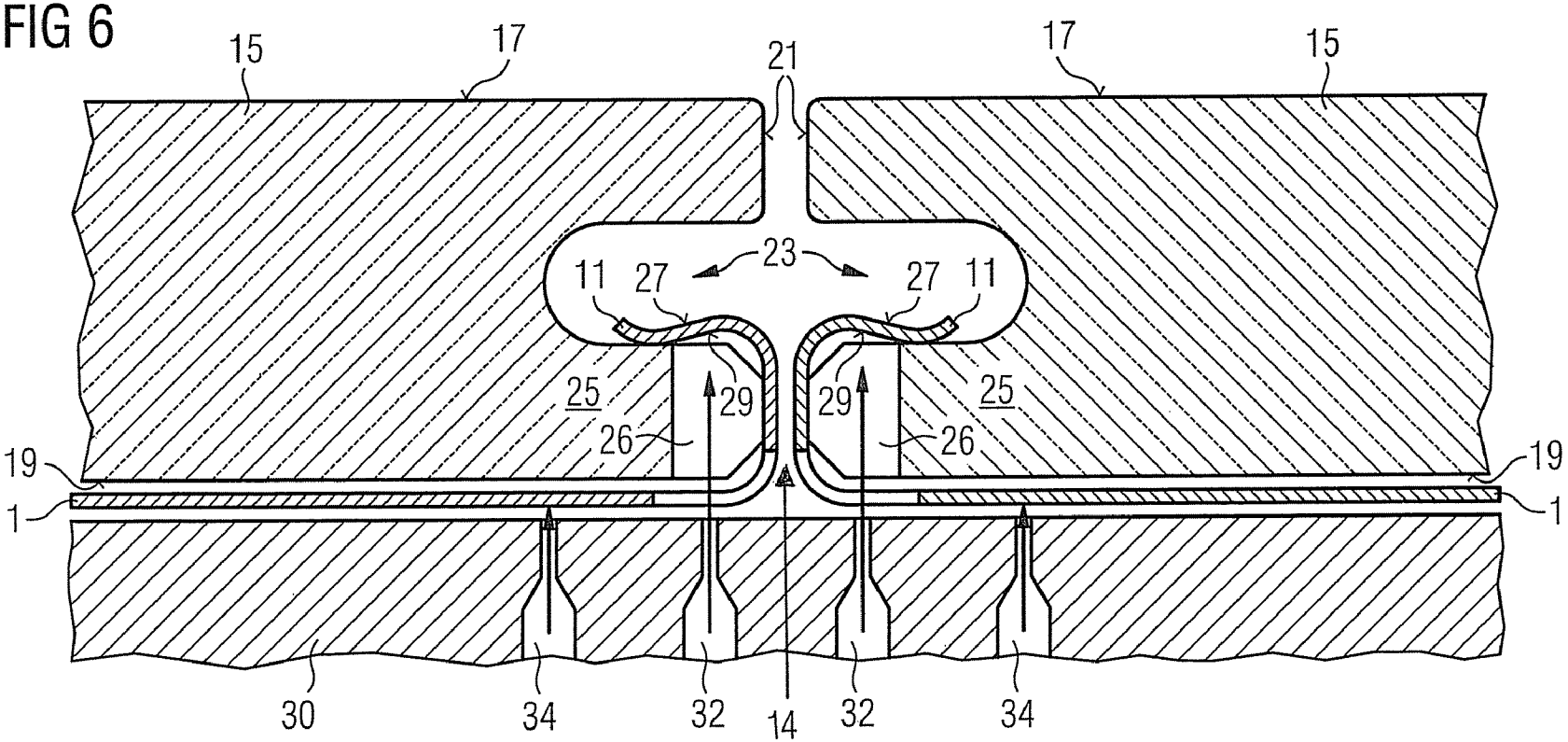
FIG. 6 shows two heat shield elements of a heat shield fixed to a supporting structure by means of element holders.

FIG. 6 shows a section of a claimed heat shield. This comprises ceramic heat shield elements 15 disposed on the surface of the supporting structure 30 of a combustion chamber wall, for example the wall of a gas turbine combustion chamber. The heat shield elements 15 are secured to the supporting structure 30 by claimed securing elements 1. Gaps 14 remain between adjacent heat shield elements 15, allowing unimpeded thermal expansion of the heat shield elements 15, if these are subject to the hot waste gases due to combustion in the gas turbine unit.

In contrast to the exemplary embodiment of the claimed heat shield shown in FIG. 6, the supporting structure can have additional cooling air openings, which can in particular be aligned with the gaps 14 between adjacent heat shield elements 15. This allows the direct blowing out of sealing air through the gaps 14 into the combustion chamber.

It should be noted that the through opening 13 in the securing springs does not have to be in the form of an elongated hole. Oval or round holes may for example also be present. Also the through opening 13 does not have to extend into the section 9 of the securing head.

The through opening can also serve as a so-called access hole for disassembly of the heat shield, in particular if the through opening 13 extends into the section 9 of the securing head 7.

The invention claimed is:

1. An elastic securing element for securing a heat shield element to a supporting structure of a gas turbine engine, comprising:

a securing head having a grip section; and a fixing section to attach the elastic securing element to the supporting structure, the fixing section having an opening that allows cooling fluid to flow from the supporting structure through the opening onto the grip section;

wherein the heat shield element has a hot side that faces a hot gas medium, and wherein the heat shield element has a groove and the elastic securing element engages in the groove of the heat shield element by the grip section of the securing head.

2. The elastic securing element as claimed in claim 1, wherein the supporting structure is selected from the group consisting of: combustion chamber, transition, turbine blade, turbine guide vane, turbine blade ring, and exhaust duct.

3. The elastic securing element as claimed in claim 1, wherein the opening is elongated.

4. The elastic securing element as claimed in claim 1, wherein the grip section has a longitudinal cross-section with a curved portion.

5. The elastic securing element as claimed in claim 1, wherein the grip section has a hot surface facing a hot medium and a cold surface opposite the hot surface, and the opening arranged so the cooling fluid is supplied directly to the cold surface.

6. The elastic securing element as claimed in claim 5, wherein a direction of fluid flow and a surface normal of the cold surface forms an angle of 20° or less.

7. A ceramic heat shield element, comprising:

a hot side that faces a hot gas medium;

a cold side that faces opposite the hot side;

a plurality of peripheral sides connecting the hot side to the cold side;

a groove configured in a peripheral side having an engagement section, the ceramic heat shield element being clamped to a supporting structure by a securing element engaging in the groove;

a material section between the groove and the cold side forming a securing section; and a recess within the securing section exposing the groove to the cold side, wherein cooling fluid is supplied through the recess directly to the securing element.

8. The ceramic heat shield element as claimed in claim 7, wherein two opposite peripheral sides contain grooves.

9. A heat shield structure, comprising:

a plurality of ceramic heat shield elements attached to an area of a supporting structure arranged to provide gaps between adjacent ceramic heat shield elements, each ceramic heat shield comprising:

a hot side to face a hot medium;

a cold side opposite the hot side;

a plurality of peripheral sides connecting the hot side to the cold side;

a groove configured in a peripheral side having an engagement section, the ceramic heat shield element being clamped to a supporting structure by a securing element engaging in the groove; and a material section between the groove and the cold side forming a securing section;

wherein the securing section has a recess along the groove up to the cold side in the area of the engagement section;

a plurality of securing elements that attach the ceramic heat shield elements to the supporting structure and have a grip portion that engages the ceramic heat shield elements;

wherein the supporting structure has a plurality of openings to supply a cooling fluid to the grip portions of the securing elements.

10. The heat shield structure as claimed in claim 9, wherein the cooling fluid flow provides impact cooling to the grip portions of the securing elements.

11. The heat shield structure as claimed in claim 9, wherein openings of the securing elements are aligned with the cooling fluid openings in the supporting structure and the recesses in the ceramic heat shield elements.

12. The elastic securing element as claimed in claim 5, wherein the hot surface of the grip section is coated with a thermal barrier coating.

* * * * *